United States Patent [19]

Russell et al.

[11] 4,330,288

[45] May 18, 1982

[54] PACKAGING MACHINE WITH POUCH TRANSFER AND OPENING MECHANISM

[76] Inventors: Robert C. Russell; Charles A. Burton; Ronald K. Coleman, all of Columbus; Dwain R. Schroeder, Columbus Grove, all of Ohio

[21] Appl. No.: 119,366

[22] Filed: Feb. 7, 1980

[51] Int. Cl.[3] ..... B31B 23/02

[52] U.S. Cl. ..... 493/197; 198/377; 493/239; 493/259

[58] Field of Search ..... 493/239, 235, 236, 369, 493/193–197, 199–202, 205, 203, 227, 259, 163; 198/377, 378; 53/561, 562, 579, 570, 384

[56] References Cited

U.S. PATENT DOCUMENTS

| | | | |
|---|---|---|---|
| 3,028,796 | 4/1962 | Neuendorf et al. | 493/236 X |
| 3,230,687 | 1/1966 | Nutting et al. | 53/561 X |
| 3,631,768 | 1/1972 | Breidenbach | 493/236 |
| 3,710,541 | 1/1973 | Izumi | 53/384 X |
| 3,728,840 | 4/1973 | Izumi | 53/562 X |
| 3,747,737 | 7/1973 | Brooke | 198/377 |
| 3,855,907 | 12/1974 | Johnson et al. | 493/235 |

FOREIGN PATENT DOCUMENTS 1073903 6/1967 United Kingdom .

OTHER PUBLICATIONS

Norman W. Carey, 4/29/80, Sketch of Bag Forming and Filling Mechanism.

Angelus Sanitary Can Machine Company, "Mitsubishi PF-15-S, Preformed Retort Pouch Filling Machine".

Klöckner Ferromatik GmbH, "Sachet Packaging Machine, PV-V".

*Primary Examiner*—James F. Coan

*Attorney, Agent, or Firm*—Leydig, Voit, Osann, Mayer & Holt, Ltd.

[57] ABSTRACT

Successive pouches severed from the leading end of a continuously moving strip of pouches are picked up by a series of spaced paddle assemblies and are turned from edgewise positions to broadwise positions. Each paddle assembly ducks into the pouch to pick up and turn the pouch and opens the pouch just prior to turning it to a broadwise position. Thereafter, the paddle assemblies release the pouches to carriers which advance the pouches through filling and closing stations. The carriers are more closely spaced than the paddle assemblies and are advanced at a slower rate than the paddle assemblies.

10 Claims, 19 Drawing Figures

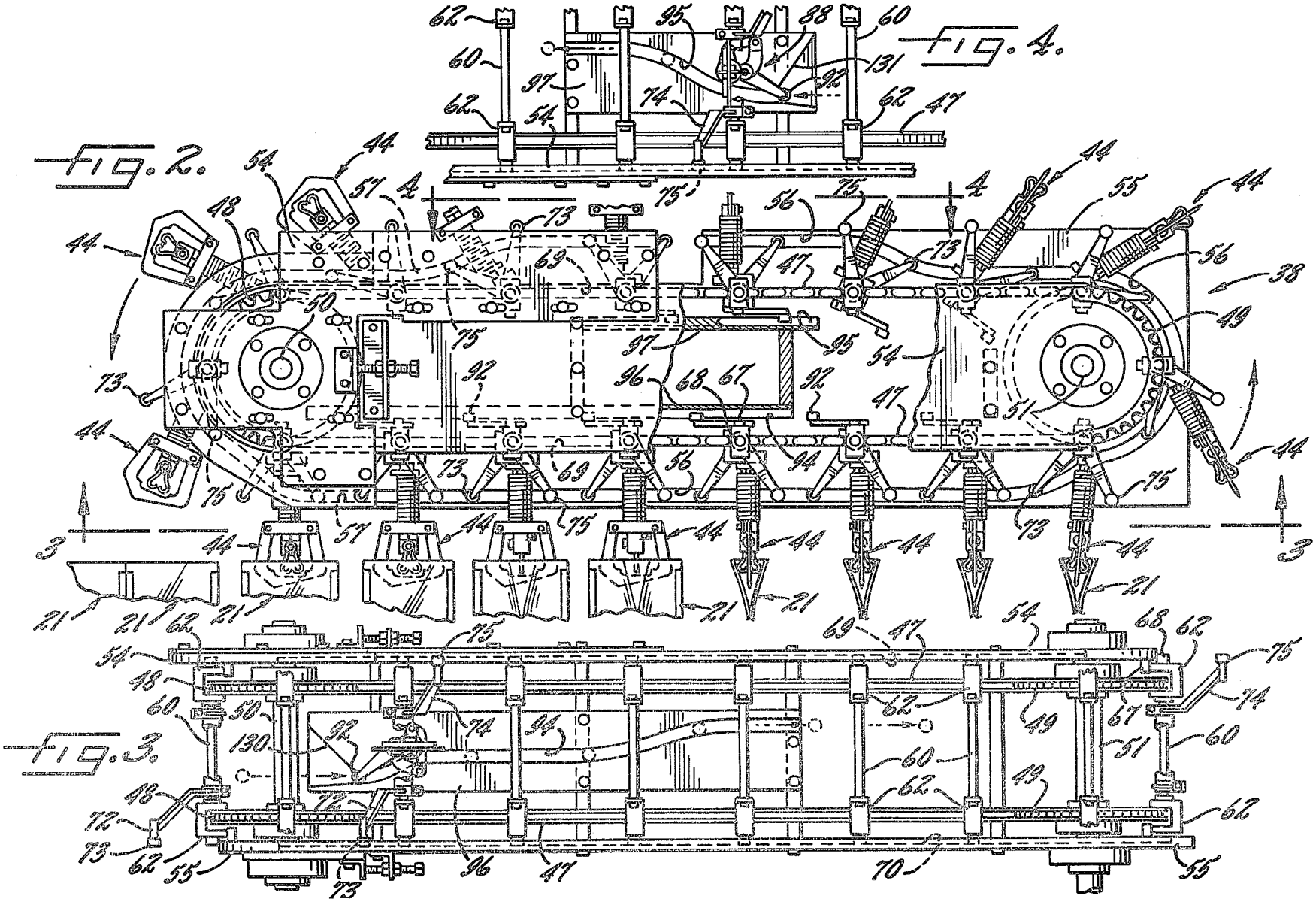

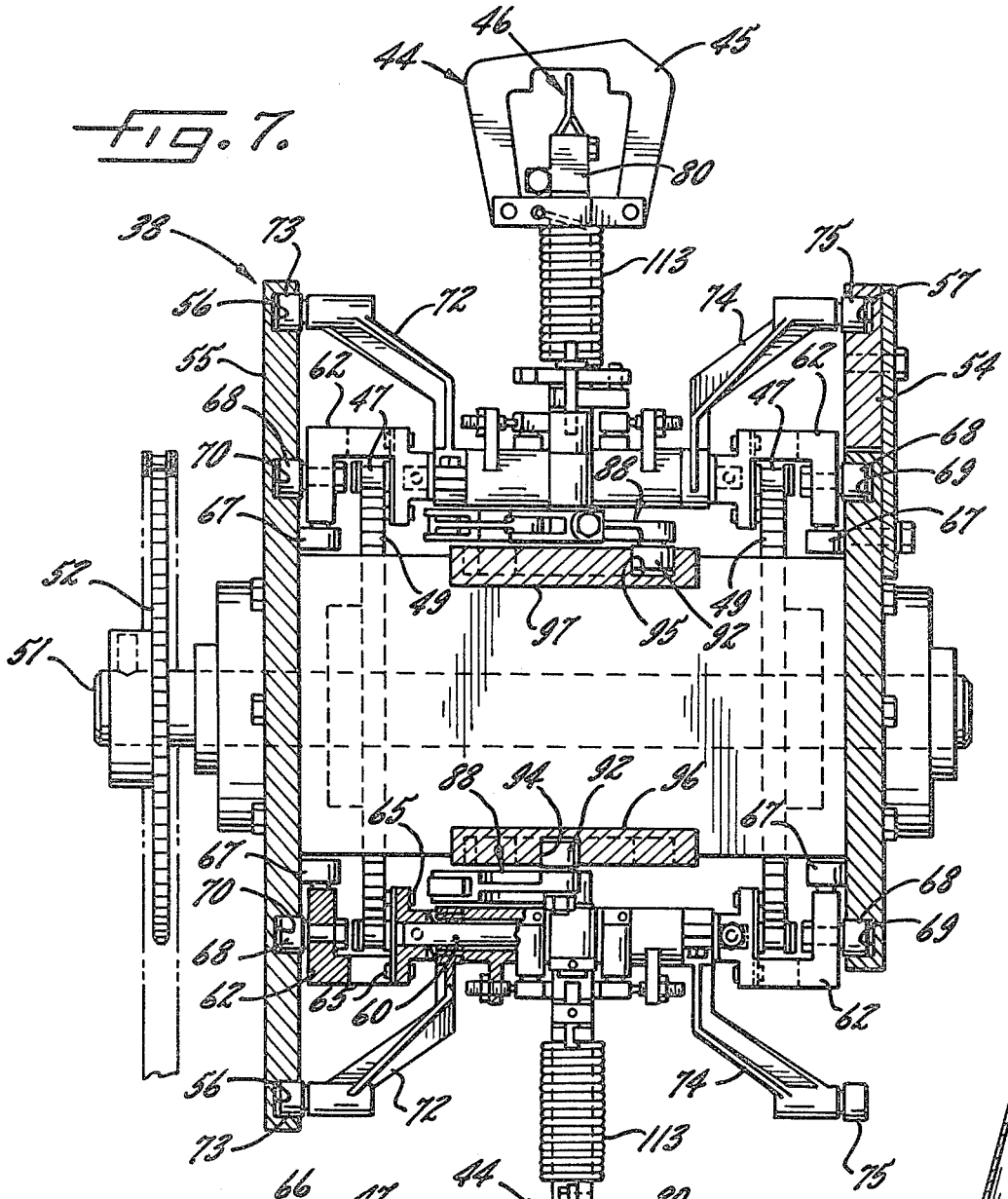
Fig. 7.
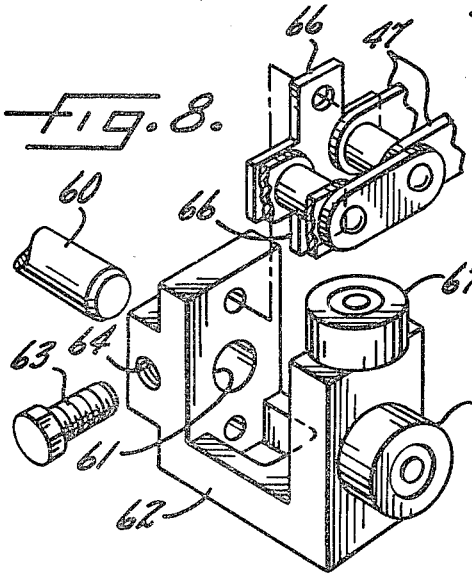
Fig. 8.
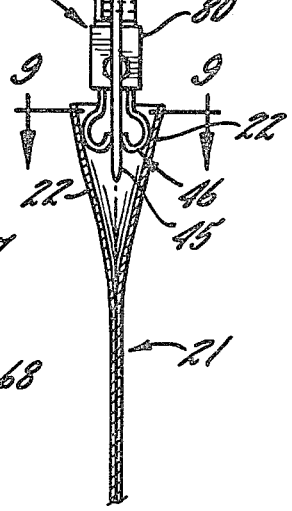
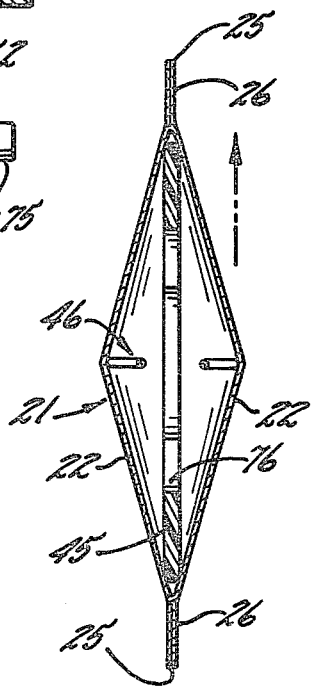
Fig. 9.

PACKAGING MACHINE WITH POUCH TRANSFER AND OPENING MECHANISM

BACKGROUND OF THE INVENTION

This invention relates to a packaging machine of the type in which a web of flexible material is folded upwardly and is sealed at spaced increments so as to form a strip of interconnected upright pouches having open upper ends. The strip is advanced in such a manner as to move the pouches edgewise to a cutting station where a cutter periodically severs successive pouches from the leading end portion of the strip.

Each severed pouch is gripped by clamps or the like carried on an endless chain and is advanced by the chain along a predetermined path through the filling and closing section of the machine. During such advance, one or more fillers deposit product into the pouches and then the upper ends of the pouches are sealed to enclose the product in the pouches.

The invention has more particular reference to a continuous motion packaging machine. In such a machine, the web, the pouch strip and the severed pouches are advanced with continuous motion as the pouch forming, filling and closing operations are performed. A typical continuous motion machine is disclosed in Nutting et al U.S. Pat. No. 3,230,687 and such a machine is capable of operating at significantly higher speeds than an intermittent motion machine in which the various operations are carried out when the pouches dwell between successive steps.

SUMMARY OF THE INVENTION

The general aim of the present invention is to provide a new and improved packaging machine which preferably is of the continuous motion type and which, when compared with prior continuous motion machines, can be more easily adapted to handle pouches of different widths, can handle a given number of pouches in a given time period while moving the pouch clamps and the associated chain at a slower speed, requires simpler and less massive filling equipment, and occupies less floor space.

A more detailed object of the invention is to achieve the foregoing by uniquely turning the pouches after the pouches have advanced edgewise past the cutter and by uniquely advancing the pouches broadwise through the filling and closing sections of the machine. By turning the pouches and advancing the pouches broadwise rather than edgewise, the center-to-center spacing between the pouches can be maintained constant regardless of the width of the pouches being handled and thus various filling and closing mechanisms can be set on common centers for pouches of all widths within a wide range of widths.

Still another object is to utilize the turning of the advancing pouches from edgewise to broadwise positions to good advantage to enable the center-to-center spacing between successive pouches to be significantly reduced. As a result of the reduced spacing between the pouches, a given number of pouches can be advanced through the filling and closing sections of the machine in a given time interval by a chain which moves at a slower speed so as to reduce the dynamic design requirements of the machine and to reduce the length of the machine as well as to enable the use of simpler filling equipment.

A further object of the invention is to provide novel mechanism having paddle assemblies which pick up the pouches advanced edgewise past the cutter and which turn the pouches to broadwise positions while opening the pouches preparatory to filling.

The invention also resides in the unique coaction between the paddle assemblies and the pouch clamps to enable the pouches to be turned and to enable the spacing between the pouches to be reduced.

These and other objects and advantages of the invention will become more apparent from the following detailed description when taken in conjunction with the accompanying drawings.

BRIEF DESCRIPTION OF THE DRAWINGS

FIG. 2 is an enlarged fragmentary front elevational view of a portion of the machine shown in FIG. 1 with certain parts being broken away and shown in cross-section.

FIGS. 3 and 4 are fragmentary cross-sectional views taken substantially along the lines 3—3 and 4—4, respectively, of FIG. 2.

FIG. 7 is an enlarged fragmentary cross-section taken substantially along the line 7—7 of FIG. 1.

FIG. 8 is an exploded perspective view of certain parts shown in FIG. 7.

FIG. 9 is an enlarged cross-section taken substantially along the line 9—9 of FIG. 7.

DETAILED DESCRIPTION OF THE PREFERRED EMBODIMENT

Figure 1:
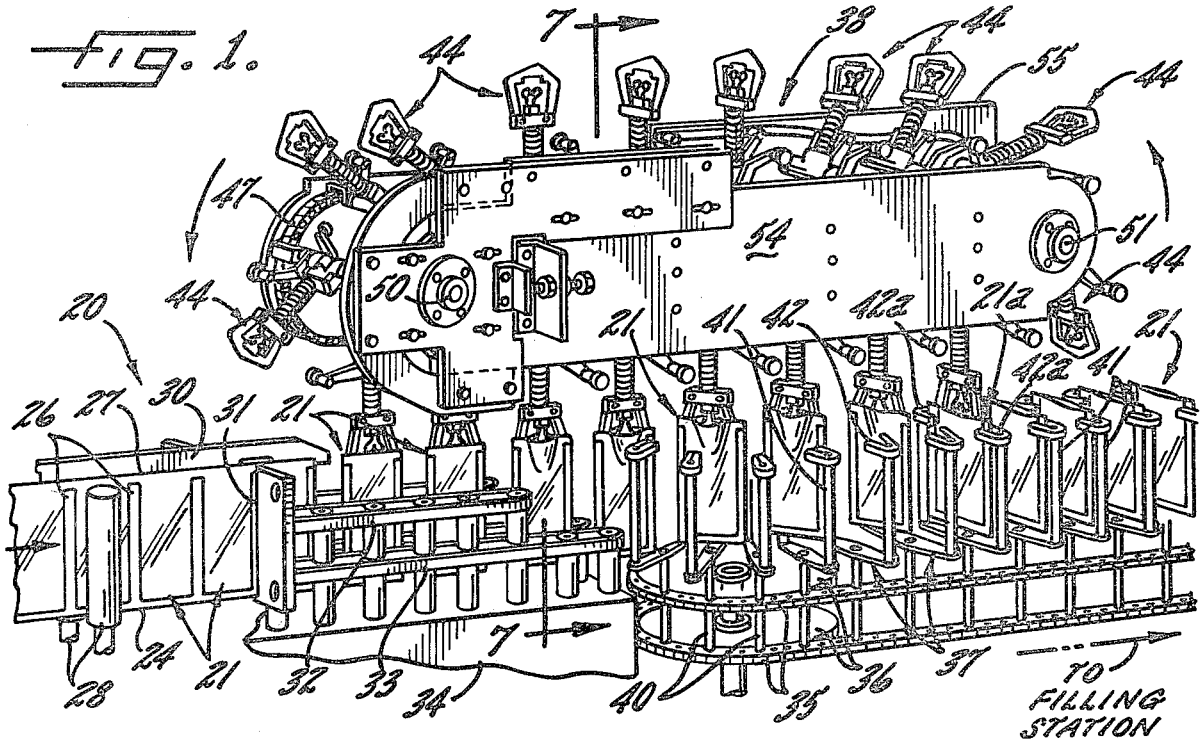
FIG. 1 is a fragmentary schematic perspective view of a new and improved packaging machine incorporating the unique features of the present invention.

As shown in the drawings for purposes of illustration, the invention is embodied in a packaging machine 20 for forming, filling and closing a pouch 21 which is composed of two rectangular panels 22 (FIGS. 7 and 8)

disposed face-to-face and joined together at their margins, preferably by a fold and a heat seal 24 at the bottom and by heat seals 25 at the sides. The pouches may range in width from 4½ inches to 7 inches and are adapted to be handled by the machine at rates as high a 250 pouches per minute.

Herein, the pouches 21 are made from a web of sheet material either composed of or coated on one side with a thermoplastic material and drawn off of a supply roll (not shown). As the web is advanced, it is folded longitudinally and upwardly and the two resulting panels are heat sealed together at horizontally spaced increments as indicated at 26 in FIG. 1 to form a strip 27 of interconnected pouches. The latter then are separated by cutting the seals 26 intermediate their edges so that each seal 26 forms the trailing side seal 25 of one pouch and the leading side seal 25 of the next pouch. After being separated from the strip, each pouch is filled with the product to be packaged and then is closed at its top by a heat seal.

The pouch strip 27 is disposed in a vertical plane and, in the present invention, is advanced with high speed continuous motion as opposed to slower intermittent or step-by-step motion. For this purpose, a pair of continuously rotating feed rolls 28 engage opposite sides of the strip and draw the web material off of the supply roll and through the pouch forming section of the machine. The upper end portions of the pouches initially are unsealed and are held in slightly spaced relation by an elongated splitter bar 30 which overlies the strip 27. The upper end portions of the pouches straddle the splitter bar as the strip is advanced and thus the bar keeps the upper ends of the pouches separated from one another.

At periodic intervals, a cutter 31 severs successive pouches 21 from the leading end portion of th strip 27 by cutting through the seals 26. The cutter has been shown only schematically in FIG. 1 since its details form no part of the present invention but it should be understood that the cutter is of the type which is capable of cutting through the strip while the latter is advanced with continuous motion. Reference may be had to the above-mentioned Nutting et al patent for a disclosure of a cutter which acts on a continuously moving pouch strip. That patent also contains a detailed disclosure of mechanisms for folding, sealing and advancing a pouch strip.

After being severed from the strip 27, the pouches 21 are accelerated to a speed greater than that of the strip in order to advance the pouches away from the cutter 31 and to space the pouches edgewise from one another for the purpose of facilitating further handling of the pouches. Herein, the pouches are accelerated by upper and lower pairs 32 and 33 of endless belts located on opposite sides of the pouch path and mounted just downstream of the cutter on a supporting base 34. The belts are driven by suitable merchanism (not shown) and are run at a constant speed which is greater than the speed at which the feed rolls 28 advance the strip 27. As each pouch moves past the cutter and is severed from the strip 27, the pouch enters between and is momentarily accelerated by the belts and is pulled away from the following pouch so as to space the two pouches edgewise from one another. In this particular instance, the belts are driven at such a speed as to establish a center-to-center spacing of about 7½ inches between adjacent pouches once the pouches have accelerated to the same speed as the belts. The lower belts 33 extend downstream a greater distance than the upper belts 32 and maintain control over the pouches for a somewhat longer period of time than the upper belts.

Shortly after leaving the accelerator belts 33, the pouches 21 are advanced through the pouch filling and closing section of the machine 20. For this purpose, two vertically spaced chains 35 (FIG. 1) are trained around power-driven sprockets 36 and support horizontally spaced pouch carriers 37 which are adapted to grip the pouches. The chains are driven continuously and serve to advance the carriers and the gripped pouches through one or more pouch filling stations where product (e.g., a food product) is deposited into the pouches. Thereafter, the pouches are advanced through a closing station where the tops of the pouches are sealed prior to the pouches being unloaded from the carriers. The specific mechanisms for filling and closing the pouches do not form part of the present invention and thus have not been illustrated. It should be noted, however, that the filling and top sealing mechanisms must be of the continuous motion type so as to be capable of operating on the continuously moving pouches. The filling mechanism, for example, may include a number of horizontally spaced heads which duck downwardly into a group of pouches, deposit product into the pouches while moving along a straight line with the pouches and then withdraw from the pouches preparatory to returning reversely to another group of pouches. Alternatively, the filling mechanism may include a series of dispensing heads spaced around a rotatable turret and operable to deposit product into the pouches as the chains 35 and the pouches move around an arc of the turret at the same speed as the turret. The top sealing mechanism also may include a series of heads spaced around a turret. The aforementioned Nutting et al patent discloses a filling mechanism and a top sealing mechanism which are adapted for use with a continuous motion packaging machine although those mechanisms are significantly different from those which are actually incorporated in the present machine 20. A turret-type filling mechanism for use with the present machine is disclosed in Burton et al U.S. application Ser. No. 119,309, filed Feb. 7, 1980, and entitled Packaging Machine With Continuous Motion Filler. A turret-type top sealing mechanism for use with the present machine is disclosed in Coleman et al U.S. application Ser. No. 119,310, filed Feb. 7, 1980, and entitled Packaging Machine With Continuous Motion Top Sealer. Both of those applications are assigned to the assignee of the present invention.

In accordance with the present invention, the pouches 21 which are advanced edgewise past the cutter 31 are turned through approximately ninety degrees and are placed in the carriers 37 for broadwise advancement to the filling and top sealing stations. Just prior to being turned, the pouches are opened to facilitate the introduction of the product into the pouches at the filling station. In addition, the center-to-center spacing of the pouches is reduced significantly as the pouches are turned from edgewise positions to broadwise positions and are placed in the carriers 37. As will be explained subsequently, several advantages are obtained as a result of turning the pouches and reducing the spacing therebetween.

Turning and opening of the pouches 21 is effected by a unique mechanism 38 (FIG. 1) which is located above the accelerator belts 32 and 33 and the carrier chains 35. Before describing the construction and operation of the turning and opening mechanism 38, however, it will be helpful to describe the carriers 37 in more detail.

As shown in FIG. 1, each carrier 37 is supported from a rod 40 secured to and projecting upwardly from the chains 35. Each carrier is substantially U-shaped and includes a pair of upwardly projecting arms 41 which are spaced transversely from one another relative to the chains 35. That is, one arm of each carrier is located outboard of the chains while the other arm is located inboard of the chains. In this particular instance, the center-to-center spacing between adjacent carriers is 4½ inches. It will be noted that this spacing is significantly less than the 7½ inch center-to-center spacing of the pouches 21 being advanced between the belts 32 and 33 and also is significantly less than the width (i.e., 7 inches) of the widest pouch adapted to be handled by the machine 20.

Supported on the upper end of each arm 41 of each carrier 37 is a pouch clamp 42 which is adapted to be selectively closed and opened to grip and release the side margin of a pouch. The two clamps 42 of each carrier 37 face each other and are spaced transversely from one another in accordance with the width of the pouches. The transverse spacing between the clamps may be selectively adjusted to accommodate pouches of different widths and, in addition, the clamps may be cammed toward and away from one another for the purpose of opening the pouch widely prior to filling and then closing the pouch prior to the top thereof being sealed. A more detailed disclosure of the construction and operation of the carriers is contained in Russell et al U.S. application Ser. No. 119,221 filed Feb. 7, 1980 and entitled Pouch Carrier and assigned to the assignee of the present invention.

In general, the mechanism 38 for turning and opening the pouches 21 comprises several (e.g., eighteen) paddle assemblies 44 which move in an endless path above the pouches 21 advanced by the belts 32 and 33 and by the carriers 37. Each paddle assembly comprises a blade-like paddle 45 and further comprises an opening device 46 (see FIG. 11). The opening device is adapted to be moved from a position (FIGS. 5, 10 and 11) disposed in the plane of the paddle to a position (FIGS. 7 and 9) disposed transversely of the paddle.

Just after each pouch 21 is first moved edgewise by the belts 32 and 33, one of the paddle assemblies 44 moves downwardly and ducks into the open end portion of the pouch in close proximity with the side seals 25 (see FIG. 5) while the opening device 46 is disposed in the plane of the paddle 45. Before the pouch leaves the control of the lower belts 33, the opening device 46 of the paddle assembly is rotated through ninety degrees about a vertical axis (see FIGS. 7 and 9) to expand or spread the side panels 22 of the pouch and to cause the edge margins 25 thereof to be contracted into engagement with the leading and trailing edges of the paddle of the paddle assembly. As a result, the pouch is retained on and held by the paddle 45 and the opening device 46 and thus moves with the paddle assembly 44 in suspended relationship therefrom as the paddle assembly continues its advance.

Figure 6:
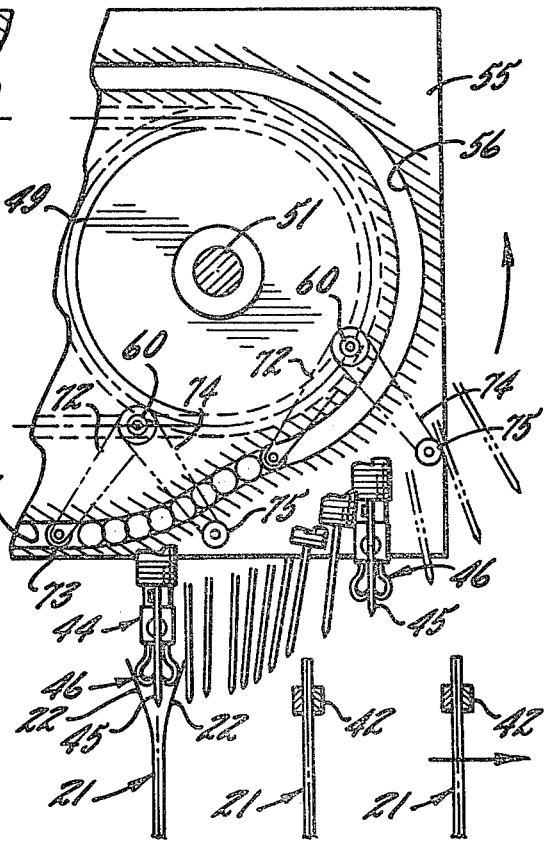
FIG. 6 is a cross-sectional view which schematically shows one of the paddle assemblies being withdrawn from a pouch.

The paddle assemblies 44 move at substantially the same speed as the belts 32 and 33 and are spaced from one another by a distance equal to the 7½ inch center-to-center spacing of the pouches 21 being advanced by the belts. Because each pouch is retained on and is suspended from its associated paddle assembly 44 after the opening device 46 has been turned, the paddle assembly advances and controls the pouch after the pouch leaves the lower belts 33. Shortly after the pouch passes from between the lower belts, the entire paddle assembly is rotated through ninety degrees about a vertical axis so as to turn the pouch from a position of edgewise advance to a position of broadwise advance (see FIGS. 1, 2 and 6).

As each pouch 21 is picked up and turned by a paddle assembly 44, the pouch passes through arms 41 and clamps 42 of carriers 37 traveling around the sprockets 36 and proceeding downstream with the chains 35 (see FIG. 1). The carriers move at a slower rate than the paddle assemblies and thus each pouch actually moves through several carriers as the pouch is picked up and turned by its paddle assembly. Just shortly after each pouch has been fully turned to its broadwise position, the pouch moves into alinement with the two open clamps 42 of one of the carriers 37 and is gripped by the clamps as the latter are closed (see the pouch 21*a* and the clamps 42*a* in FIG. 1). As the clamps close, the paddle assembly 44 is retracted upwardly out of the pouch and thus control of the pouch is transferred from the paddle assembly to the carrier 37 (see FIG. 6). Since the spacing between the carriers is less than the spacing between the paddle assemblies, the center-to-center spacing between the pouches is reduced from 7½ inches to 4½ inches as an incident to the pouches being delivered to and then being moved along by the carriers. Although the chains 35 and the carriers 37 move at a slower rate than the paddle assemblies, the reduced spacing between the pouches made possible by turning the pouches to broadwise positions enables the carriers to handle the same number of pouches in a given time period as would be the case if the carriers were advanced at the same speed as the paddle assemblies and received the pouches in edgewise positions.

Turning now to the details of the turning and opening mechanism 38, the paddle assemblies 44 are spaced along and are carried by a pair of transversely spaced and horizontally extending chains 47 (FIGS. 2 and 3) which are trained around upstream and downstream pairs 48 and 49 of transversely spaced sprockets. The sprockets 48 and 49 are mounted on transversely extending horizontal shafts 50 and 51, respectively, and the downstream shaft 51 is adapted to be rotated counterclockwise (FIG. 2) in order to advance the lower runs of the chains 47 from left to right. Rotation of the downstream shaft is effected by a chain drive 52 shown in FIG. 7.

The shafts 50 and 51 are rotatably supported by front and rear frame plates 54 and 55. Formed in the forward side of the rear frame plate 55 is a groove or cam track 56 (FIG. 6) whose function will be explained subsequently. The cam track 56 begins at a point adjacent the lower forward portion of the frame plate 55, extends horizontally along the lower edge portion of the plate 55, curves upwardly around the rear downstream sprocket 49 and then terminates adjacent the upper edge portion of the frame plate 55 about midway along the length thereof. A second groove or cam track 57 (FIG. 5) is formed in the rear side of the front frame plate 54 and starts just after the cam track 56 ends. The cam track 57 curves downwardly around the forward upstream sprocket 48 and terminates along the lower edge of the front frame plate 54 just after the cam track 56 begins. The full extent of the cam tracks 56 and 57 is shown in FIG. 2.

Each paddle assembly 44 is supported on a horizontal pivot shaft 60 (FIGS. 7 and 10) which spans the front and rear chains 47. As shown in FIGS. 7 and 8, each end portion of each pivot shaft is telescoped into a hole 61 formed in the inboard side of a generally U-shaped mounting bracket 62 and is held rigidly by a screw 63 which is threaded into a tapped hole 64. Each bracket straddles one of the chains 47 and is secured thereto by screws 65 which extend through upper and lower mounting ears 66 on the chain.

The outboard side of each mounting bracket 62 supports two rollers 67 and 68 (FIGS. 7 and 8) which are journaled to rotate about vertical and horizontal axes, respectively. The roller 67 of each front bracket rides along the rear side of the front frame plate 54 while the roller 68 of each front bracket fits within a guide groove 69 (FIG. 7) formed in the rear side of the front frame plate. In a similar manner, the roller 67 of each rear bracket 62 rides along the front side of the rear frame plate 55 while the roller 68 of each rear bracket rides in a guide groove 70 formed in the front side of the rear frame plate. The rollers guide and stabilize the pivot shafts 60 and prevent the chains 47 from sagging under the weight of the shafts.

Each paddle assembly 44 includes a generally transversely extending housing 71 (FIGS. 10 and 14) which is journaled to turn on the pivot shaft 60. Clamped rigidly to the rear end portion of each housing is an arm 72 whose free end carries a roller 73 adapted to ride in the rear cam track 56. Another arm 74 is clamped rigidly to the forward end of each housing and carries a roller 75 adapted to ride in the front cam track 57. Only one roller 73, 75 of any given paddle assembly 44 is disposed in one of the cam tracks 56, 57 at any given time and, when one of the rollers is so disposed, certain portions of the track 56, 57 cause the adjacent arm 72, 74 to rock and to turn the housing 71 about the pivot shaft 60. Such turning causes the paddle assemblies 44 to duck into and withdraw from the pouches 21 in a manner to be explained subsequently.

As pointed out above, each paddle assembly 44 includes a blade-like paddle 45 and an opening device 46. Each paddle is formed with a central opening or window 76 (FIG. 11) within which the opening device is disposed. The opening device is adapted to be turned relative to the paddle from a first position (FIG. 11) in which the opening device is disposed in the plane of the paddle to a second position (FIGS. 7 and 9) in which the opening device extends transversely of the paddle.

Herein, each opening device 46 is formed by a spring member which is in the shape of an inverted U and which includes two resiliently yieldable legs 77 (FIG. 11) having outwardly bowed lower end portions 78. The upper portions of the legs are integral with a tubular spring coil 79 (FIG. 10) which is suitably secured within a mounting collar 80. The latter is fastened rigidly to the lower end portion of an upright shaft 81 (FIG. 12) whose upper end portion extends rotatably through the housing 71.

Clamped rigidly to the upper end portion of each shaft 81 is one end portion of a link 82 (FIG. 14) whose opposite end portion is pivotally connected at 84 to one end of a second link 85. The other end of the latter link is connected at 86 to one arm 87 of a bellcrank 88 which is pivotally mounted on an upright pin 90 projecting upwardly from and fastened to the housing 71. The bellcrank 88 includes a second arm 91 whose free end carries a roller 92.

The roller 92 of each paddle assembly 44 is adapted to ride in either a lower cam track 94 (FIGS. 2 and 3) or an upper cam track 95 (FIGS. 2 and 4) and coacts with those cam tracks to effect turning of the shaft 81, the opening device 46 and the paddle 45 as the paddle assembly is moved by the chains 47. As shown in FIG. 3, the lower cam track 94 is formed in the lower side of a fixed cam plate 96 which is located between the frame plates 54 and 55 just above the lower runs of the chains 47. The upper cam track 95 is formed in the upper side of an upper cam plate 97 which also is fixed between the frame plates and which is located just below the upper runs of the chains. As each paddle assembly 44 moves with the lower runs of the chains, the roller 92 enters the lower cam track 94 and is cammed thereby so as to rock the bellcrank 88 and the links 85 and 82 and effect turning of the shaft 81 through 180 degrees in one direction. Each roller 92 enters into and is cammed by the upper cam track 95 as the paddle assembly moves in an inverted position with the upper runs of the chains and, as an incident thereto, the roller acts through the bellcrank and the links to turn the shaft 81 through 180 degrees in the opposite direction.

Figure 15:
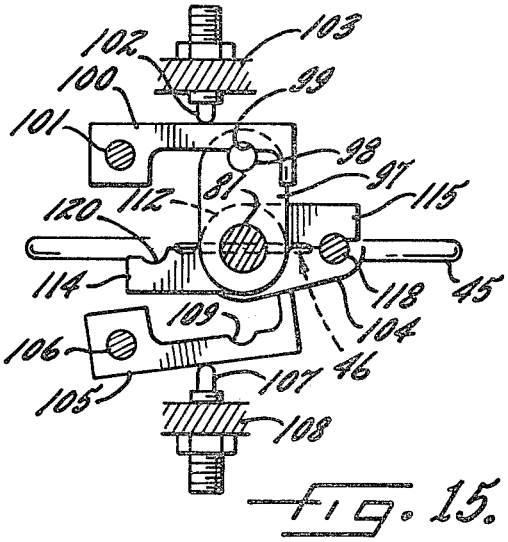
FIG. 15 is a fragmentary cross-section taken substantially along the line 15—15 of FIG. 11.

To prevent undesirable oscillation of the shaft 81 and to hold the shaft fixed when the roller 92 is not in either cam track 94 or 95, the shaft is adapted to be latched releasably in each of its extreme positions. For this purpose, a radially projecting ear 97 (FIG. 15) is fastened securely to the shaft about midway along the length thereof and carries a vertically projecting detent pin 98. When the shaft 81 is positioned as shown in FIG. 15 such that the opening device 46 is disposed in the plane of the paddle 45, the detent pin 98 is received within a notch 99 which is formed in a latch 100. The latch is secured to the lower end of a vertical pivot pin 101 supported rotatably by the housing 71 and is urged toward the detent pin 98 by a spring-urged plunger 102, the latter being mounted on a boss 103 formed integrally with and depending from the housing 71.

Engagement of the latch 100 with the detent pin 98 releasably holds the shaft 81 and the ear 97 in the position shown in FIG. 15 and restricts turning of the shaft. When the cam track 94 acts on the roller 92 to turn the shaft 81 counterclockwise, the detent pin 98 cams the latch 100 counterclockwise about the axis of the pivot pin 101 and moves out of the notch 99 so as to release the shaft for turning. Thereafter, the plunger returns the latch in a clockwise direction until the free end of the latch stops against a horizontally projecting boss 104 (FIG. 19) formed integrally with the forward end portion of the housing 71.

Figure 19:
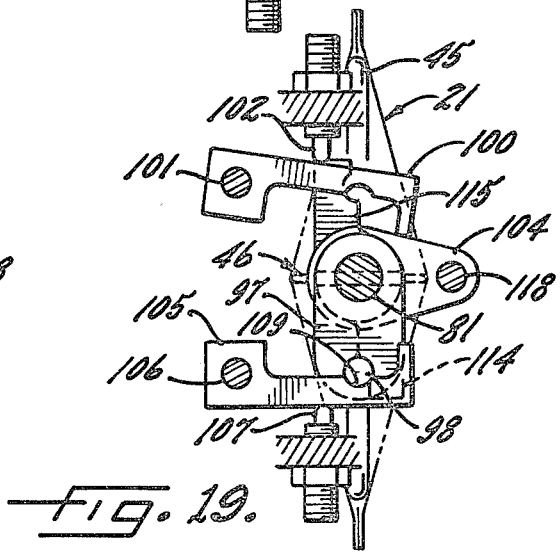
FIG. 19 is a view similar to FIGS. 15 and 17 with certain parts being shown in still further moved positions.

Shortly before the shaft 81 turns counterclockwise through 180 degrees from the position shown in FIG. 15 to the position shown in FIG. 19, the detent pin 98 engages a second latch 105 and cams that latch clockwise about the axis of a vertical pivot pin 106 supported rotatably by the housing 71. The latch 105 is urged in a counterclockwise direction by a spring-loaded plunger 107 and its free end normally engages and is stopped by the ear 104. The plunger 107 is mounted on a downwardly projecting boss 108 which is formed integrally with the rear end portion of the housing 71.

When the shaft 81 completes its counterclockwise turn, the detent pin 98 moves into a notch 109 in the latch 105 and thus further turning of the shaft is restricted. The detent pin cams the latch 105 open when the cam track 95 subsequently causes the shaft 81 to turn in a clockwise direction and, as the shaft completes its turn, the detent pin cams past and is again held by the latch 100. As the shaft 81 turns, the opening device 46 also turns since the opening device is fixed to the shaft.

Figures 10, 11, 12, 13:
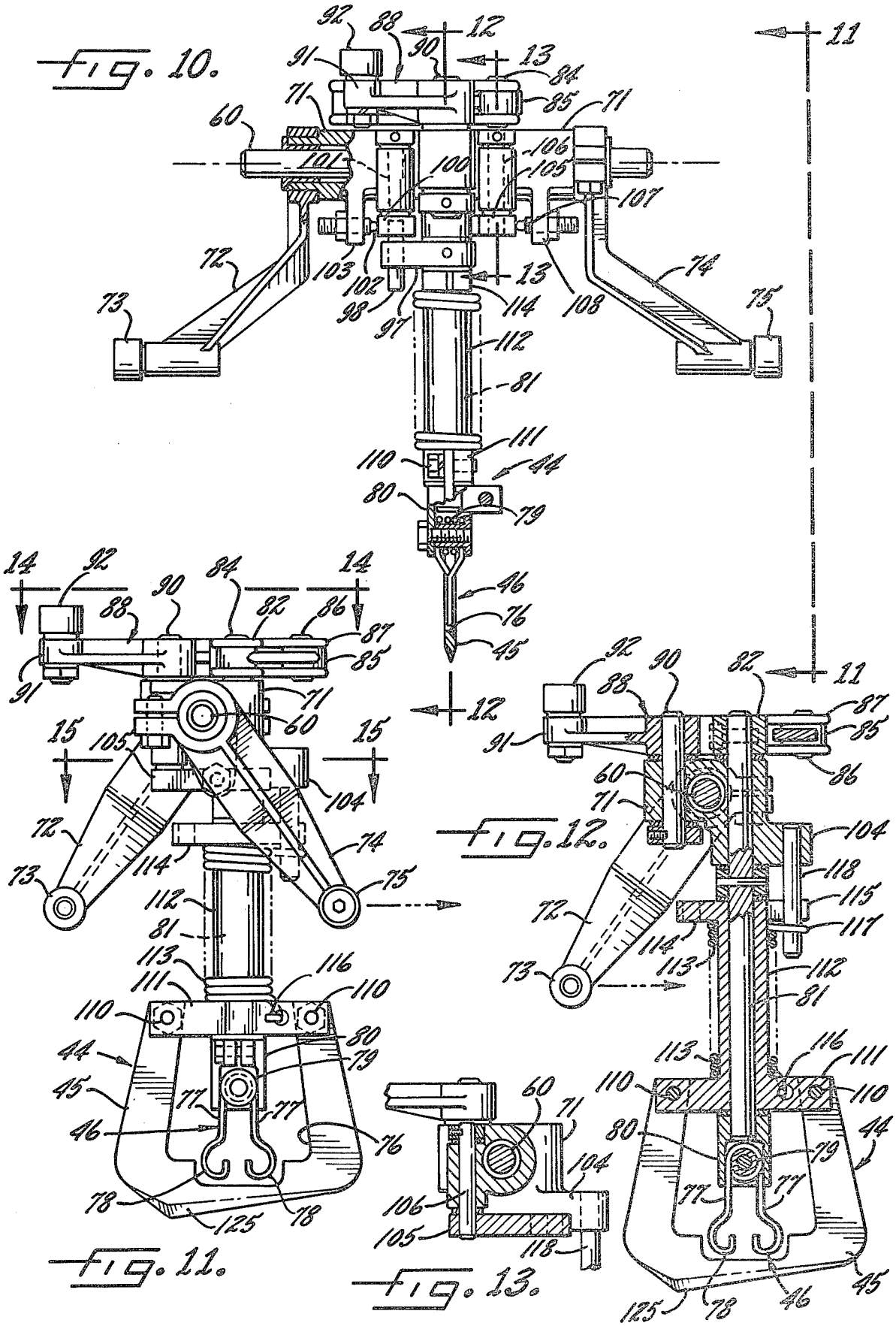
FIG. 10 is an enlarged view of one of the paddle assemblies shown in FIG. 7 with certain parts being broken away and shown in cross-section and with certain parts being shown in moved positions.
FIG. 11 is an elevational view of the paddle assembly shown in FIG. 10 with the view being taken substantially along the line 11—11 of FIG. 10.
FIGS. 12 and 13 are fragmentary cross-sections taken substantially along the lines 12—12 and 13—13, respectively, of FIG. 10.

Part of the turning movement which is undertaken by the shaft 81 of each paddle assembly 44 is used to turn the paddle 45 from a position effecting edgewise advancement of the associated pouch 25 to a position effecting broadwise advancement of the pouch. As shown in FIG. 12, the upper end of each paddle 45 is bolted at 110 to a bar 111 which is formed on the lower end of a sleeve 112. The sleeve is mounted rotatably on the shaft 81 and is captivated axially between the collar 80 and the ear 104. A coiled torsion spring 113 is telescoped over the sleeve and is captivated between the bar 111 and a pair of angularly spaced and radially extending lugs 114 and 115 on the upper end of the sleeve 112. One end 116 of the spring is anchored to the bar 111 while the other end 117 of the spring is anchored to a stop pin 118 secured rigidly to the housing 71 and projecting downwardly beyond the lug 115. The spring is wound so as to bias the sleeve 112 to turn in a clockwise direction (FIG. 15) on the shaft 81. Clockwise turning of the sleeve beyond the position shown in FIG. 15 is prevented by virtue of the lug 115 engaging the stop pin 118.

Figure 14:
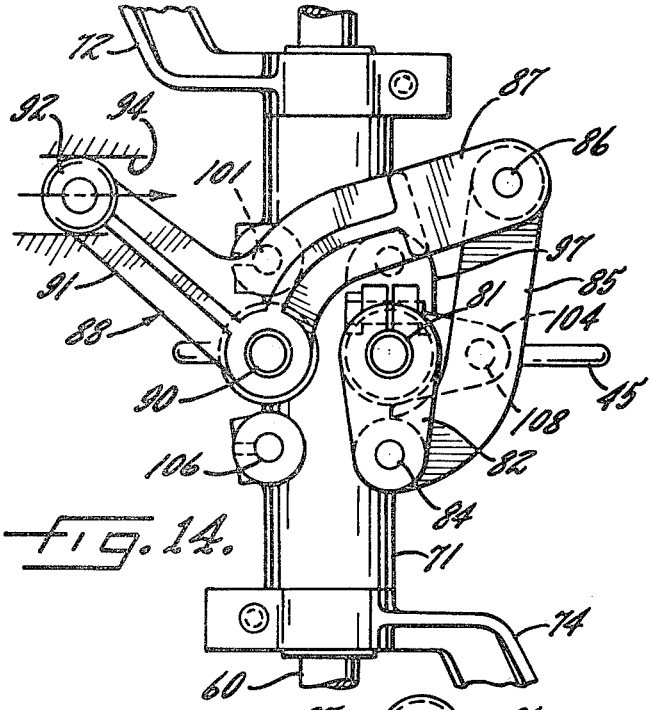
FIG. 14 is a top plan view of the paddle assembly shown in FIG. 11 with the view being taken substantially along the line 14—14 of FIG. 11.

When the shaft 81 of each paddle assembly 44 is positioned as shown in FIGS. 14 and 15, the paddle 45 is positioned so as to effect edgewise advancement of the pouch 21, and the opening device 46 is positioned in the plane of the paddle. When the lower cam track 94 first begins turning the shaft 81 in a counterclockwise direction and the latch 100 releases, the opening device 46 turns with the shaft but the paddle 45 remains stationary until the opening device has been turned through ninety degrees by the shaft and is extending transversely of the paddle (see FIGS. 16 and 17). As the opening device reaches its transverse position, the detent pin 98 on the ear 97 seats within a notch 120 formed in one edge of the lug 114.

Figure 18:
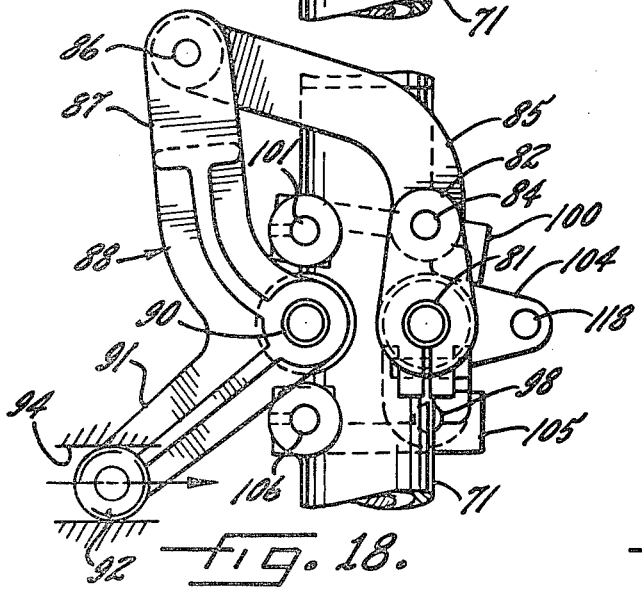
FIG. 18 is a view similar to FIGS. 14 and 16 but shows certain parts in still further moved positions.

Upon counterclockwise turning of the shaft 81 through its final ninety degrees, the detent pin 98 bears against the lug 114 and causes the sleeve 112 and the paddle 45 to turn in unison with the shaft and the opening device 46 (see FIGS. 18 and 19). Thus, the paddle is turned so as to re-orient the pouch 21 from an edgewise position to a broadwise position, the opening device turning simultaneously with the paddle so that the position of the opening device relative to the pouch and the paddle remains unchanged. As the sleeve 112 turns, the torsion spring 113 tends to unwind and, when the shaft 81 completes its final ninety degrees of turning, the latch 105 engages the detent pin 98 to restrict further turning of the shaft and the sleeve and to hold the sleeve against the action of the torsion spring.

When the upper cam track 95 causes the shaft 81 to turn in a clockwise direction, the detent pin 98 tends to move away from the lug 114 and, as a result, the torsion spring 113 turns the paddle 45 and the sleeve 112 clockwise through ninety degrees until the lug 115 engages the stop pin 118 to prevent further turning of the paddle. Accordingly, the spring 113 returns the paddle from a broadwise position to an edgewise position as the shaft 81 turns clockwise through its first ninety degrees and turns the opening device 46 in unison with the paddle. During the final ninety degrees of clockwise rotation of the shaft 81, the opening device 46 is turned relative to the paddle 45 from a position extending transversely of the paddle to a position extending transversely of the paddle.

SUMMARY OF OPERATION

Figure 5:
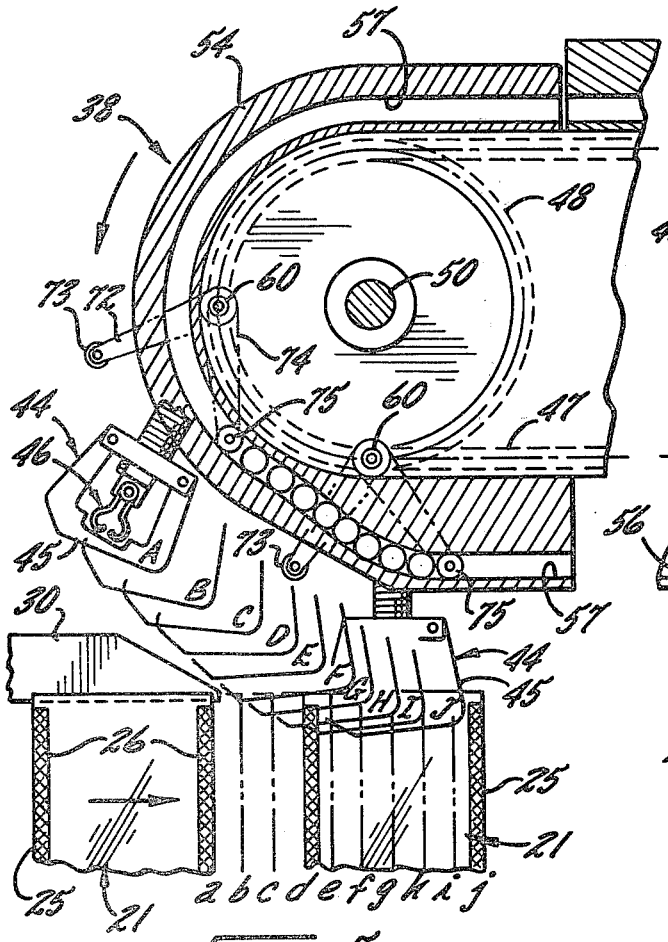
FIG. 5 is a cross-sectional view which schematically shows one of the paddle assemblies ducking into a pouch.

To best gain an understanding of the overall operation of the pouch turning and opening mechanism 38, let it be assumed that one of the paddle assemblies 44 is just starting to travel downwardly around the upstream sprockets 48 as shown in FIG. 5. When the paddle assembly is in this position, the forward cam roller 75 on the forward arm 74 of the housing 71 is disposed within the cam track 57 of the front frame plate 54 while the rear cam roller 73 on the rear arm 72 is free of the cam track 56 in the rear frame plate 55. Also, the paddle 45 is turned so as to effect edgewise advance of the pouches 21, the opening device 46 is disposed in the plane of the paddle, and the shaft 81 is held in a rotationally stationary position by the latch 100 (see FIGS. 5, 14 and 15).

As the paddle assembly 44 proceeds downwardly around the upstream sprockets 48, the cam track 57 acts on the roller 75 and the arm 74 and causes the housing 71 to swing counterclockwise about the horizontal pivot shaft 60 and thereby position the paddle for entry into the pouch 21 being severed from the strip 27. The path which the paddle follows in ducking into the pouch is shown schematically in FIG. 5. In this view, the letters A to J indicate successive positions occupied by the paddle 45 as the shaft 60 moves around the sprockets 48 through equal angular increments from a nine o'clock position to a six o'clock position. The letters a to j indicate the corresponding positions occupied successively by the leading edge of the pouch 21 most recently severed from the strip 27 and being advanced off of the splitter bar 30 by the belts 32 and 33.

As shown in FIG. 5, the cam track 57 rocks the shaft 60 and causes the paddle 45 to move to a nearly vertical position as the paddle proceeds between positions A and E and as the pouch 21 starts to leave the splitter bar 30. Shortly before the trailing edge of the pouch leaves the splitter bar, the cam track 57 causes the trailing end of the paddle to dip downwardly into the trailing end portion of the pouch (see position F) and thereby keep the upper ends of the side panels 22 of the pouch spread apart. The trailing end portion of the lower side of the paddle is somewhat plow-shaped as indicated at 125 in FIG. 11 and then the lower side tapers to a virtual edge 126 upon proceeding toward the leading end of the paddle.

Just after the paddle 45 first enters into the pouch 21, the cam track 57 causes the paddle to rock in an upstream direction in order to match the speed of the paddle to that of the pouch (see the positions G to I). At the same time, the paddle is continuously lowered into the pouch to cause the leading and trailing ends of the paddle to move into close proximity with the side seals 25 and to place the opening device 46 between the side panels 22. When the paddle and the pouch reach the positions J and j, respectively, the paddle has assumed its final position and is being moved at the same speed as the pouch and the belts 32 and 33.

After the paddle 45 reaches its final position in the pouch 21, the forward cam roller 75 leaves the forward cam track 57 and immediately thereafter the rear roller 73 enters the rear cam track 56, the rear roller being located in trailing relation with respect to the front roller. The rear track 56 parallels the lower runs of the chains 47 and thus the paddle 45 is held at a constant elevation as it moves with the lower runs. At about the same time the rear roller 73 enters the rear track 56, the upper cam roller 92 enters into the lower cam track 94 by way of an enlarged throat 130 (FIG. 3) at the entrance end of that track.

Just shortly before the pouch 21 leaves the control of the upper belts 32, a bend in the lower cam track 94 begins turning the shaft 81 counterclockwise (FIG. 15) to move the opening device 46 transversely out of the plane of the paddle 45, the latch 100 releasing automatically so as to free the shaft for turning. Before the pouch leaves the lower belts 33, the shaft 81 is turned through ninety degrees and turns the opening device 46 to a position in which the opening device is disposed at right angles to the paddle 45. In so turning, the opening device 46 spreads the side panels 22 of the pouch 21 and thereby partially opens the pouch preparatory to filling. As the side panels are spread, the edge margins 25 of the pouch are contracted or pulled inwardly into engagement with the leading and trailing ends of the paddle 45 (see FIGS. 7 and 9). As a result, the pouch is held by the paddle 45 and the opening device 46 and moves in suspended relationship therewith after leaving the lower belts 33.

Figure 16:
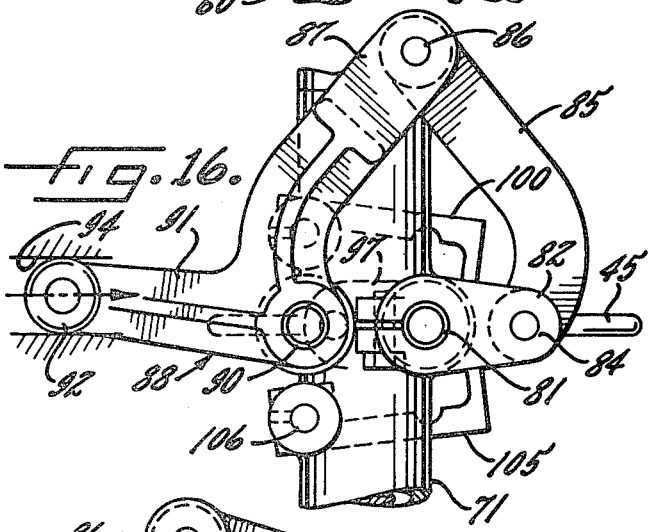
FIG. 16 is a view similar to FIG. 14 but shows certain parts in moved positions.
Figure 17:
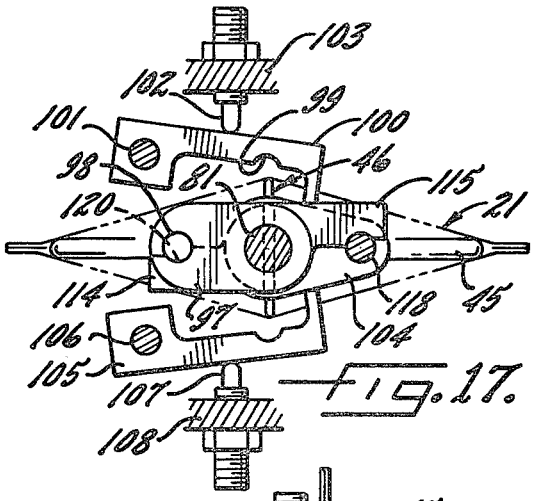
FIG. 17 is a view generally similar to FIG. 15 with certain parts being shown in moved positions.

After the paddle assembly 44 acquires control of the pouch 21, a bend in the lower cam track 94 causes the shaft 81 to turn gradually in a counterclockwise direction through its final ninety degrees from the position shown in FIGS. 16 and 17 to the position shown in FIGS. 18 and 19. The opening device 46 thus is turned but, at the same time, the detent pin 98 engages the lug 114 to turn the sleeve 112 and the paddle 45 in unison with the opening device. Accordingly, the pouch 21 is turned through ninety degrees from an edgewise position to a broadwise position but the position of the opening device within the pouch is not changed. After the pouch has been fully turned, the latch 105 restricts further turning of the shaft 81 and shortly thereafter the roller 92 leaves the lower cam track 94.

As the pouch 21 is being turned to its broadwise position, it advances through and passes by a number of the slower moving carriers 37 on the chains 35. Ultimately, the pouch catches up with the proper carrier and moves into alinement with the clamps 42 of that carrier (see the pouch 21*a* and the clamps 42*a* in FIG. 1). As an incident thereto, the rear cam track 56 momentarily rocks the lower end portion of the paddle 45 in an upstream direction to slow the pouch down to the speed of the carrier 37. During such rocking, the clamps 42 of the carrier close upon and grip the pouch and, at the same time, the rear cam track 56 retracts the paddle upwardly out of the pouch to release the pouch to the control of the carrier. The successive positions occupied by the paddle as the latter rocks the pouch and then retracts from the pouch are shown schematically in FIG. 6. As pointed out above, the center-to-center spacing between the pouches is reduced from 7½ inches to 4½ inches as control of the pouches is transferred from the paddle assemblies 44 to the more closely spaced and slower moving carriers 37.

After being retracted from the pouch 21, the paddle assembly 44 proceeds upwardly around the downstream sprockets 49 and moves with the upper runs of the chains 47 while in an inverted and inclined position. During such movement, the rear cam track 56 rocks the paddle assembly to an upright position. Shortly thereafter, the cam roller 92 enters the upper cam track 95 by way of an enlarged entrance throat 131 (FIG. 4) and, as the roller moves along the track, the latter causes the shaft 81 to turn through 180 degrees and in a clockwise direction as viewed in FIG. 19. During the first ninety degrees of turning, the paddle 45 and the opening device 46 rotate in unison with the paddle being turned by the spring 113 as the detent pin 98 moves away from the lug 114. After the paddle 45 has been stopped in its edgewise position by virtue of the lug 115 engaging the stop pin 118, the shaft 81 rotates the opening device 46 through an additional ninety degrees to return the opening device to the plane of the paddle 45. The latch 100 engages the detent pin 98 to restrict further turning of the shaft 81 and then the roller 94 leaves the upper cam track 95. At about the time the paddle and the opening device are turned, the rear roller 73 leaves the rear cam track 56 while the front roller 75 enters the front cam track 57 preparatory to the paddle assembly 44 again proceeding around the upstream sprockets 48 to begin another cycle.

SUMMARY OF ADVANTAGES

Several advantages are obtained as a result of turning the pouches 21 from edgewise positions to broadwise positions. First, the packaging machine 20 may be more easily adapted to handle pouches of different widths within a wide range of widths (e.g., 4½ inches to 7 inches). Once manufactured, a given machine most usually will only run pouches of a particular width and usually will not be changed over in the field to run pouches of a different width. Because the pouches are turned to broadwise positions, however, the expense and complexity of initially designing and manufacturing different machines to handle pouches of different widths is reduced since many of the components and mechanisms for all machines may be standardized.

Specifically, turning of the pouches 21 to broadwise positions enables the same center-to-center spacing to be maintained between pouches of all widths as the pouches are advanced by the chains 35 through the filling and closing sections of the machine 20. As a result, various mechanisms such as the filler heads and the top sealing heads may be located at the same positions for all pouches so as to avoid the need of establishing the location and timing of such mechanisms in accordance with pouches of a particular width. In addition, the lengthwise position and spacing of the carriers 37 along the chains 35 can remain constant for all pouches. This eliminates the necessity of locating the carriers at different positions along the chains and enables chains of the same pitch to be used by virtually all machines. Moreover, the clamps 42 of the carriers are located in readily accessible positions on the inboard and outboard sides of the chains 35 rather than being located between the pouches 21.

As pointed out above, turning of the pouches 21 to broadwise positions also enables the center-to-center spacing between the pouches to be kept relatively small (i.e., 4½ inches) when the pouches are advanced by the carriers 37. It is, of course, impossible to advance 7 inch pouches edgewise with such small spacing and it would be virtually impossible to effect edgewise advance of 4 inch pouches with such spacing.

By virtue of the relatively close spacing between the pouches 21, a given number of pouches may be advanced through a given distance in a given time interval by chains 35 which move slower than would be the case with pouches of greater spacing. Accordingly, the chains 35 and all of the mechanisms (e.g., the filler heads and the sealing heads) which move with the pouches may be driven at slower speeds so as to reduce the dynamic design requirements of the machine 20. The product may be introduced into the pouch at a slower rate to reduce splashing and spillage. Also, the filler heads and the sealing heads may be more closely spaced and thereby enable a reduction in the floor space required by the machine. And, if the manufacturer chooses to use higher chain speeds, the reduced spacing between the pouches enables a greater number of pouches to be handled in a given period of time so as to increase the production rate of the machine.

We claim:

1. A packaging machine having means for advancing a strip of interconnected, upright and open-ended pouches edgewise along a predetermined path with the open ends of the pouches facing upwardly and disposed at a predetermined elevation, means for periodically cutting successive leading pouches from the strip, means for turning each severed pouch ninety degrees about its vertical centerline, and means for advancing the pouch broadwise toward a filling station while keeping the upper end of the pouch disposed at said predetermined elevation and while keeping the centerline of the pouch moving along a linear path.

2. A packaging machine having means for advancing a strip of interconnected, upright and open-ended pouches edgewise along a predetermined path at a predetermined speed with the open ends of the pouches facing upwardly, means for periodically cutting successive leading pouches from the strip as the latter is advanced, means for moving the severed pouches edgewise and at a speed greater than that of the strip thereby to advance the pouches in spaced edgewise relation, mechanism for advancing the spaced pouches with continuous motion while turning each pouch ninety degrees about its vertical centerline from a position in which the pouch moves edgewise to a position in which the pouch moves broadwise, and means for thereafter gripping the pouches and for moving the pouches broadwise toward a filling station.

3. A packaging machine as defined in claim 2 in which said mechanism comprises a series of spaced assemblies movable at said greater speed and spaced from one another substantially in accordance with the edgewise spacing between the pouches, said gripping means comprising a series of spaced carriers movable at a speed slower than the speed of said assemblies and spaced from one another by a distance less than the spacing between said assemblies.

4. A packaging machine having means for advancing a strip of interconnected, open-ended pouches edgewise at a first predetermined speed with the open ends of the pouches facing upwardly, means for periodically cutting successive leading pouches from the strip as the latter is advanced, means for continuously moving the severed pouches edgewise along a predetermined path and at a second speed greater than that of the strip thereby to advance the pouches in spaced edgewise relation, a series of paddles spaced from one another substantially in accordance with the edgewise spacing between the pouches, means for causing successive paddles to duck downwardly into the open ends of successive severed pouches and for thereafter moving the paddles along said predetermined path substantially at said second speed, means for causing said pouches to be held on said paddles whereby the pouches are moved edgewise by said paddles, means for thereafter turning each of said paddles through approximately ninety degrees about an upright axis thereby to cause the paddle to turn the associated pouch and advance the pouch broadwise, means for gripping each turned pouch and for moving the pouch broadwise, and means for withdrawing the paddle from the pouch while said gripping means continue the broadwise advance of the pouch.

5. A packaging machine as defined in claim 4 which includes a series of gripping means spaced from one another by a distance less than the spacing between said paddles and movable at a speed which is slower than the speed of said paddles.

6. A packaging machine as defined in claim 5 in which substantially U-shaped carriers support said gripping means, each pouch and its associated paddle moving through several of said carriers before the pouch is gripped by said gripping means.

7. A packaging machine having means for advancing a strip of interconnected, open-ended and flat pouches edgewise at a first predetermined speed with the open ends of the pouches facing upwardly, each of said pouches having a predetermined width and being formed by a pair of opposed side panels, means for periodically cutting successive leading pouches from the strip as the latter is advanced, means for continuously moving the severed pouches edgewise along a predetermined path and at a second speed greater than that of the strip thereby to advance the pouches in spaced edgewise relation, a series of paddle assemblies spaced from one another substantially in accordance with the edgewise spacing between the pouches, means for causing successive paddle assemblies to duck downwardly into the open ends of successive severed pouches and for thereafter moving the paddle assemblies along said predetermined path substantially at said second speed, each of said paddle assemblies comprising a paddle extending edgewise of the pouch and having a width less than the width of the flat pouch, each of said paddle assemblies further comprising an opening device mounted to turn relative to said paddle and about an upright axis between a first position extending generally parallel to the side panels of the pouch and a second position extending transversely of said side panels, each of said opening devices being disposed in said first position and moving downwardly between the side panels of the pouch when the respective paddle assembly ducks downwardly into the pouch, means for turning each opening device from its first position to its second position after the respective paddle assembly has ducked into the pouch whereby the opening device spreads the side panels of the pouch and causes the upright edge margins thereof to contract around the leading and trailing ends of the respective paddle, each pouch being retained on and being moved by the respective paddle when the associated opening device is in its second position, means operable after each opening device has been turned to its second position for turning both the opening device and the associated paddle through approximately ninety degrees about an upright axis thereby to cause the opening device and the paddle to turn the retained pouch and advance the pouch broadwise, means for gripping each turned pouch and for moving the pouch broadwise, and means for withdrawing the paddle from the pouch while said gripping means continue the broadwise advance of the pouch.

8. A packaging machine as defined in claim 7 which includes a series of gripping means spaced from one another by a distance less than the spacing between said paddles and movable at a speed which is slower than the speed of said paddles.

9. A packaging machine as defined in claim 7 in which each of said paddles comprises a blade-like member having leading and trailing ends and having a window disposed between said ends, said opening device being located within said window.

10. A packaging machine as defined in either of claims 7, 8 or 9 in which each of said opening devices comprises a member substantially in the shape of an inverted U and having a pair of resiliently yieldable legs.

* * * * *